United States Patent [19]

Smith, III

[11] 4,449,660

[45] May 22, 1984

[54] FASTENER TOOL

[75] Inventor: Somers H. Smith, III, Columbia, Md.

[73] Assignee: Black & Decker Inc., Newark, Del.

[21] Appl. No.: 259,456

[22] Filed: Apr. 30, 1981

[51] Int. Cl.[3] ..... B25C 1/06

[52] U.S. Cl. ..... 227/8; 227/131; 227/90

[58] Field of Search ..... 227/8, 90, 131, 120

[56] References Cited

U.S. PATENT DOCUMENTS

| | | | |
|---|---|---|---|
| 1,823,644 | 9/1931 | Cossock | 227/131 |
| 1,845,617 | 2/1932 | Metcalf | 227/131 |
| 3,169,559 | 2/1965 | Working, Jr. | 227/131 X |
| 4,042,036 | 8/1977 | Smith et al. | 227/131 X |
| 4,121,745 | 10/1978 | Smith et al. | 227/8 |
| 4,129,240 | 12/1978 | Geist | 227/8 |
| 4,161,272 | 7/1979 | Brockl | 227/131 |
| 4,204,622 | 5/1980 | Smith et al. | 227/7 |
| 4,298,072 | 11/1981 | Baker et al. | 227/131 X |
| 4,323,127 | 4/1982 | Cunningham | 227/8 X |

*Primary Examiner*—Paul A. Bell

*Attorney, Agent, or Firm*—Ronald B. Sherer; Harold Weinstein; Charles E. Yocum

[57] ABSTRACT

A fastener tool having a housing in which is mounted a universal motor to be continuously operated during operation of the tool. A gear driven by the motor is a rotary driven member. A drive pin is carried by the gear to rotate therewith and is free to be shifted axially relative the gear. A drive bar is mounted in the housing to drive fasteners. The drive pin is connectable to the drive bar to produce a power stroke and a return stroke. An interrupt mechanism is operative to prevent successive power strokes, and in the preferred embodiment it will include the drive pin; it will act to disconnect the drive pin from the drive bar. Also the interrupt mechanism will control the connection of the drive pin and drive bar. The maximum number of power strokes are one-half the number of rotary cycles of the rotary driven member. The interrupt mechanism includes a linkage for sensing workpiece engagement and operator actuation of the tool, each of which are required to produce a single power stroke. The interrupt mechanism may also include a track and shifter to axially shift the drive pin. The drive bar has a slot which in a start position is aligned to receive or release the pin during a predetermined 45° arc of gear rotation. A detent will yieldly hold the drive bar in the start position.

23 Claims, 24 Drawing Figures

FASTENER TOOL

BACKGROUND OF THE INVENTION

1. Field of the Invention

A fastener tool such as a stapler, nailer or the like has a continuously running motor and a driven member such as a gear coupleable to a reciprocal drive bar in a power stroke for driving fasteners at a maximum rate of not more than once for every two rotary cycles of the gear. When fastening is not desired the motor will remain on but the drive bar will not partake of a power stroke. In the preferred embodiment a drive pin is included in and controlled via an interrupt means selectively to couple and uncouple the drive bar and the driven member. The drive bar partakes of a power stroke and a return stroke, and will be positively driven to cycle from a start position in which it receives or releases the pin during a predetermined dwell angle.

The interrupt mechanism also includes a track and shifter moveable to control the drive pin responsive to an arming linkage which senses the existence of system parameters such as workpiece engagement and operator actuation of the tool.

2. Description of the Prior Art

Fastening tools of the prior art used various power sources such as electric or pneumatic motors, compression springs and the like, to power a ram or other impact member in a positive manner, but such devices had a drive or return stroke which relied on the stored energy in: (1) the system; (2) the impact member; or (3) a drive or return spring. Pairs of flywheels, motor driven, were also used as a power source to drive a ram, but as noted above though the drive was positive, the return was not. Some prior art fastener tools were powered by a solenoid. In any event, all prior art fastener tools were believed to have one or more disadvantages as follows: complex; heavy; hard to control; unstable; and/or expensive.

Another feature found in the prior art is in the nature of a direct drive wherein the motor is mechanically coupled directly to the impact member so that power strokes are on a one-to-one basis with the cycles of operation of the motor. Accordingly, the fastener tool's motor had to have sufficient energy to drive the fasteners.

Examples of various prior art patents may be found as follows: Motor powered—U.S. Pat. Nos. 1,823,644; 1,845,617 (remote motor); Solenoid powered—U.S. Pat. No. 3,169,559; Pair of flywheels—motor powered—U.S. Pat. Nos. 4,204,622; 4,121,745; 4,042,036.

SUMMARY OF THE INVENTION

A fastener tool having a continuous running motor to drive a rotary transmission and a reciprocal driving bar is coupled through an interrupt mechanism to produce up to one power stroke for each two cycles of revolution of the transmission. In the preferred embodiment the interrupt mechanism includes a drive pin which mechanically connects the transmission and the drive bar to positively drive the bar in a power stroke and a return stroke. The interrupt mechanism also includes a track, a shifter and arming linkage which co-act to control the drive pin in the coupling and uncoupling of the drive bar.

It is an object of the present invention to provide an improved fastener tool which overcomes the prior art disadvantages; which is simple, economical and reliable; which is light weight, smaller in size and stable to operate; which has a drive bar mechanically reciprocated through a power stroke and a return stroke; which has a continuously running rotary power source; which power source is a continuously running universal motor; which uses an improved interrupt mechanism to prevent successive power strokes; which uses an interrupt mechanism selectively to couple and uncouple the drive bar and a rotary power source to produce one power stroke, and to prevent successive power strokes; which interrupt mechanism includes a shiftable drive pin to couple and to uncouple the drive bar and rotary power source; which interrupt mechanism interconnects the drive bar and the rotary power source to produce a maximum number of the power strokes at a rate of one-half the number of cycles of rotation of the rotary driven member; which interrupt mechanism includes a drive pin, a track, a lever, a shifter and arming linkage to produce a power stroke and prevent successive power strokes.

Another object of the present invention is to provide an improved fastener tool which has an interrupt mechanism which cycles the power strokes at a lesser rate than the cycles of the rotation of the rotary driven member and prevents successive power strokes relative thereto; which uses a drive pin carried by a gear connectable with and releasable from the drive bar during a predetermined arc of rotation of the gear; which uses a dual surface track upon which a follower of the drive pin will ride; which uses a shifter selectively to position the follower on a front of the track or a rear of the track; and which shifter is operative responsive to system parameters, such as engagement of the workpiece and operator actuation of the tool.

Other objects and advantages of the present invention will be apparent from the description of the following illustrative embodiment. The novel features of the invention are pointed out in the claims.

BRIEF DESCRIPTION OF THE DRAWINGS

The invention is illustrated in the accompanying drawings in which:

FIG. 4*a* shows the insertion and retraction of the drive pin during a predetermined dwell angle; FIG. 4*b* shows the power stroke; FIG. 4*c* shows the drive bar at the end of the impact with a fastener; and FIG. 4*d* shows the return stroke.

FIGS. 11, 12 and 13 are perspective views of the arming linkage of the interrupt mechanism shiftable responsive to the system parameters wherein FIG. 11 shows the alignment rod adjacent the "X" line representing the unarmed mode; FIG. 12 shows the alignment rod advanced to just cross the "X" line responsive to the trigger being pivoted on as indicated by the heavy arrow but the linkage remains unarmed in that the actuator base is still a good distance behind the "X" line; FIG. 13 shows the linkage armed in that the alignment rod has been advanced to adjacent the "Y" line and the actuator base is adjacent the "X" line responsive to the dual actuation of the trigger, and the probe lever being raised responsive to the tool contacting the workpiece.

DESCRIPTION OF THE PREFERRED EMBODIMENT

Figure 1:
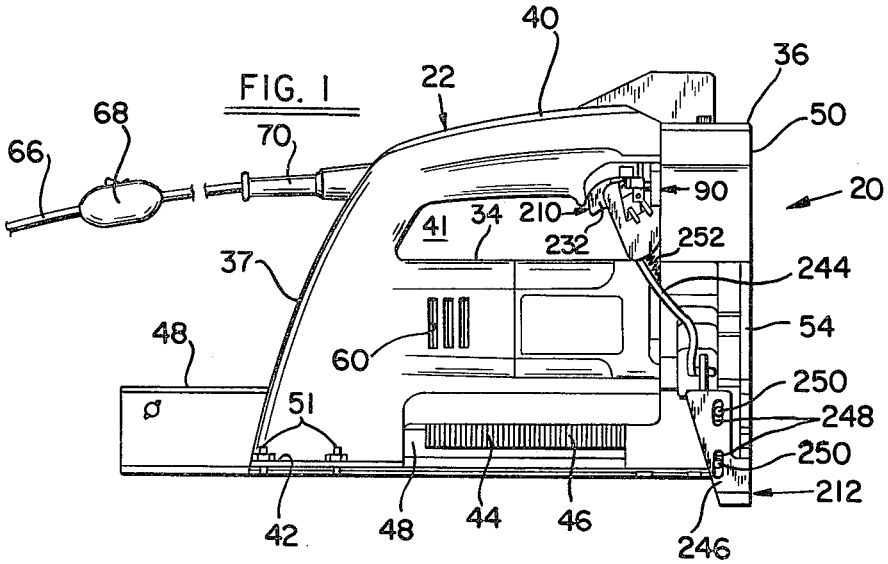
FIG. 1 is a side elevational view of the improved fastener tool of the present invention, with the front thereof facing rightwardly.
Figure 2:
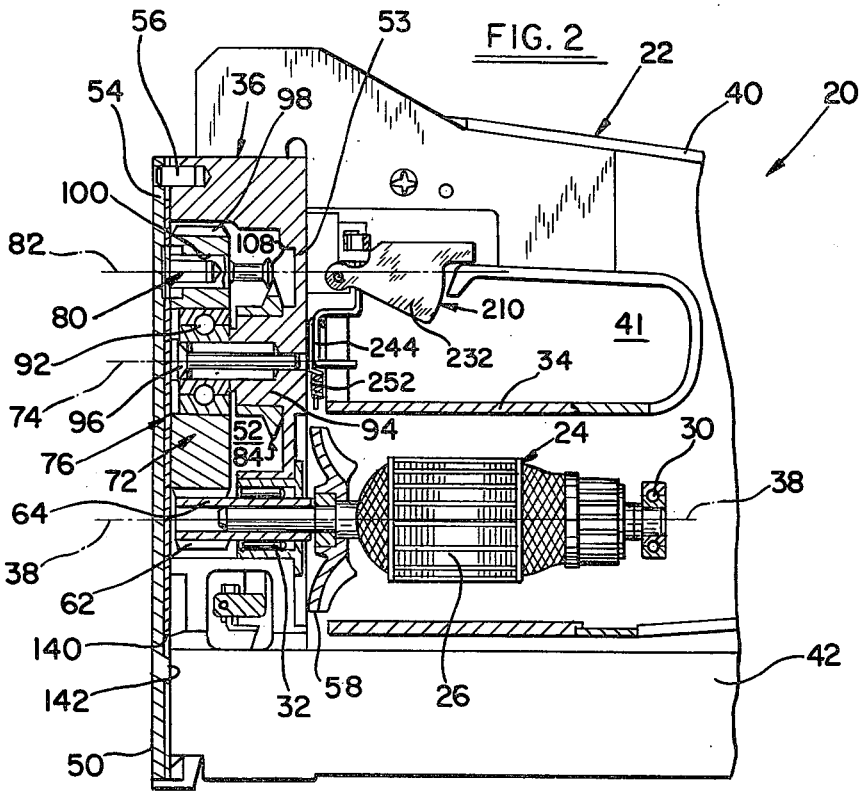
FIG. 2 is a sectional side elevational view of the improved fastener tool, with the front thereof facing leftwardly.
Figures 6, 6A, 6B, 6C, 7:
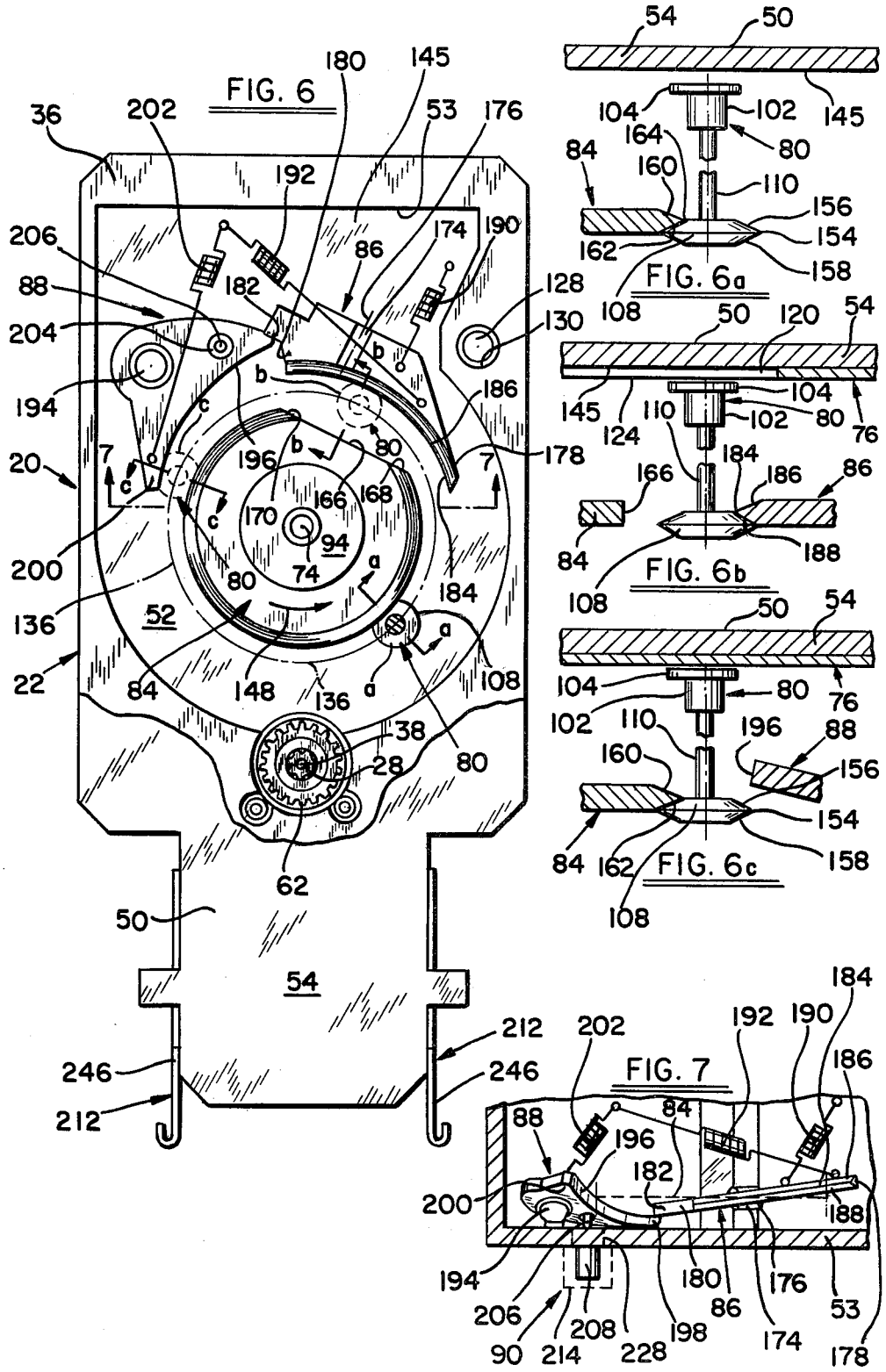
FIG. 6 is a front elevational view partly in section and partly broken away showing the interrupt mechanism including the drive pin follower on the rear of the track, with the drive pin shown at locations "a" (solid), and at locations "b" (dotted) and "c" (dotted), respectively.
FIGS. 6*a*, 6*b* and 6*c* are each sectional views taken along lines "a—a", "b—b" and "c—c", respectively, of FIG. 6 corresponding to the noted locations "a", "b" and "c", respectively, of the drive pin of FIG. 6.
FIG. 7 is a partial sectional view taken along line 7—7 of FIG. 6 showing the lever and the shifter to ramp the drive pin to the rear of the track, and wherein the track is shown in phantom.

In the illustrated embodiment of the invention a fastener tool described generally as 20, is shown in FIGS. 1, 2 and 6. The tool 20 has a housing 22 in which is mounted a suitable power source, such as a universal motor 24 shown diagramatically in FIG. 3 and partially in FIG. 2. The motor 24 has an armature 26 and an armature shaft 28 journaled in a pair of bearings 30 and 32 affixed in a horizontal motor casing 34, and gear case portion 36, respectively. The forward portion of the motor casing 34 is connected to the vertically disposed gear case portion 36 of the housing 22. The armature shaft 28 has an axis 38.

The housing 22 has a curved handle portion 40 which extends from the rear top of the gear case portion 36 in spaced relationship to the motor casing 34 to turn downwardly at the rear 37 of the housing 22 to join into the motor casing 34. The handle portion 40 forms an aperture 41 for convenient gripping of the tool 20 by the operator, and aids in its control and manipulation. A reinforcing web 42 extends from the bottom of the rear 37 of the housing 22 adjacent the motor casing 34.

The fastener tool 20 may be designed to drive any conventional fasteners, such as staples, tacks, nails or the like which are available in the market, with staples being the representative fastener shown in the preferred embodiment herein. Individual staples 44, in the form of a slide pack 46 containing a plurality of staples as is shown in FIG. 1 are loaded into a suitable magazine 48 in which the pack 46 will be biased toward the front 50 of the housing 22. The magazine 48 is an integral part of, or may be attached to the housing 22 and/or web 42 in any conventional manner, such as by fasteners 51 shown in FIG. 1.

The gear case portion 36 of the housing 22 defines a cavity 52 shown is FIG. 2 which opens outwardly from a rear wall 53 toward the front 50 and is enclosed by a flat front cover 54 secured to the gear case portion 36 by fasteners 56, one of which is shown in FIG. 2.

Figure 3:
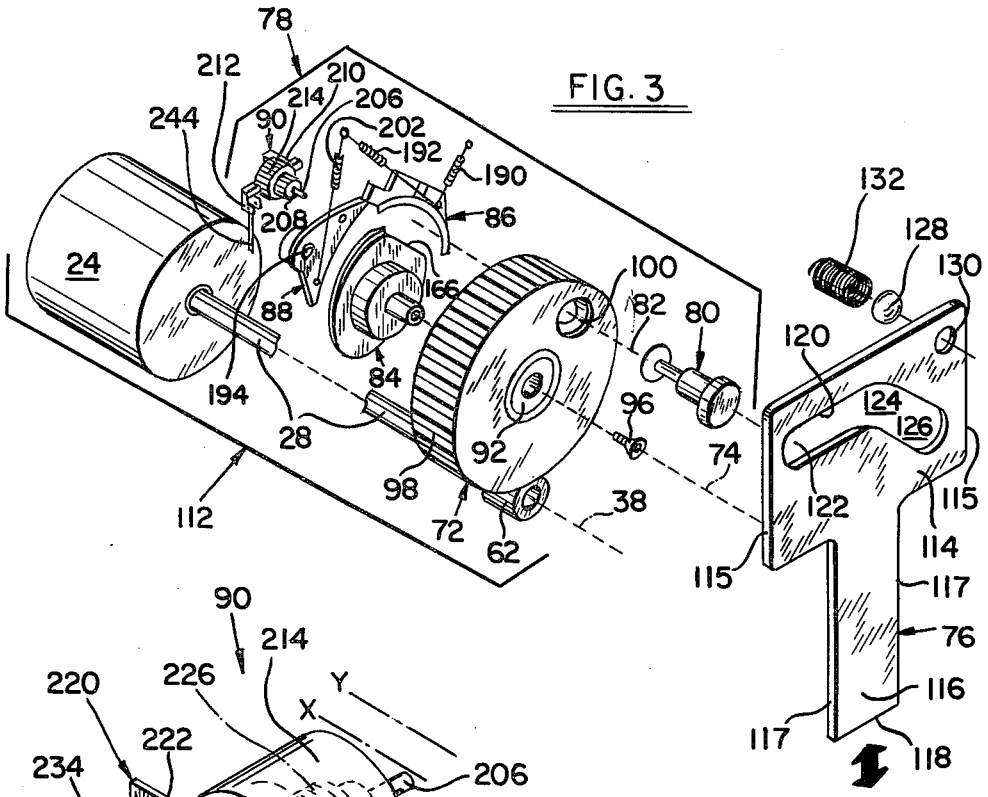
FIG. 3 is an exploded perspective view of the improved fastener tool, without the housing, and showing some main components such as the rotary power source, the drive bar and the interrupt mechanism including the drive pin, the track, the shifter, the lever and the arming linkage.

A fan 58 is affixed to the front side of the armature shaft 28 as shown in FIG. 2, for conventional cooling of the motor 24 whereby air will enter and exit through suitable vent openings of the motor casing 34, with only the inlet opening 60 being shown in FIG. 1. A pinion 62 may be formed integrally with the armature shaft 28, or as shown in FIGS. 2, 3 and 6 preferably is formed on the front end of a hollow sleeve 64 affixed to the front portion of the armature shaft 28 at the front bearing 32.

The motor 24 is designed to operate continuously for extended periods of time at a no load speed in the range of 28,000 to 30,000 rpm, and loaded rotates at about 27,000 rpm. The motor 24 develops about 15 foot pounds of force in the fastener tool 20. The motor is rated at substantial 0.25 horsepower ("HP") and develops a maximum of approximately 0.50 HP. Electrical energy will be supplied to the motor 24 through a line cord 66 which is connected in-circuit with the motor 24 through an "on"—"off" switch 68, with the cord being connected to the handle portion 40 of the housing 22 through a strain relief 70 as shown in FIG. 1. The motor 24 will be energized by actuating the switch 68 to the "on" position and will run continuously thereafter until deenergized by shifting the switch 68 to the "off" position. The pinion 62 being affixed to the armature shaft 28 will rotate simultaneously with the armature shaft 28.

In addition to the housing 22, the motor 24 and the magazine 48, the fastener tool 20 is made up of various assemblies, subassemblies and components which will be described more fully hereinafter, and are merely identified herein and referred to in connection with FIG. 3 as follows: a driven member or gear 72 having an axis of rotation 74; a drive bar 76; and an interrupt mechanism 78, including a drive pin 80 having an axis 82, a track 84, a shifter 86, a lever 88 and an arming linkage 90.

Figures 4A, 4B, 4C, 4D, 5:
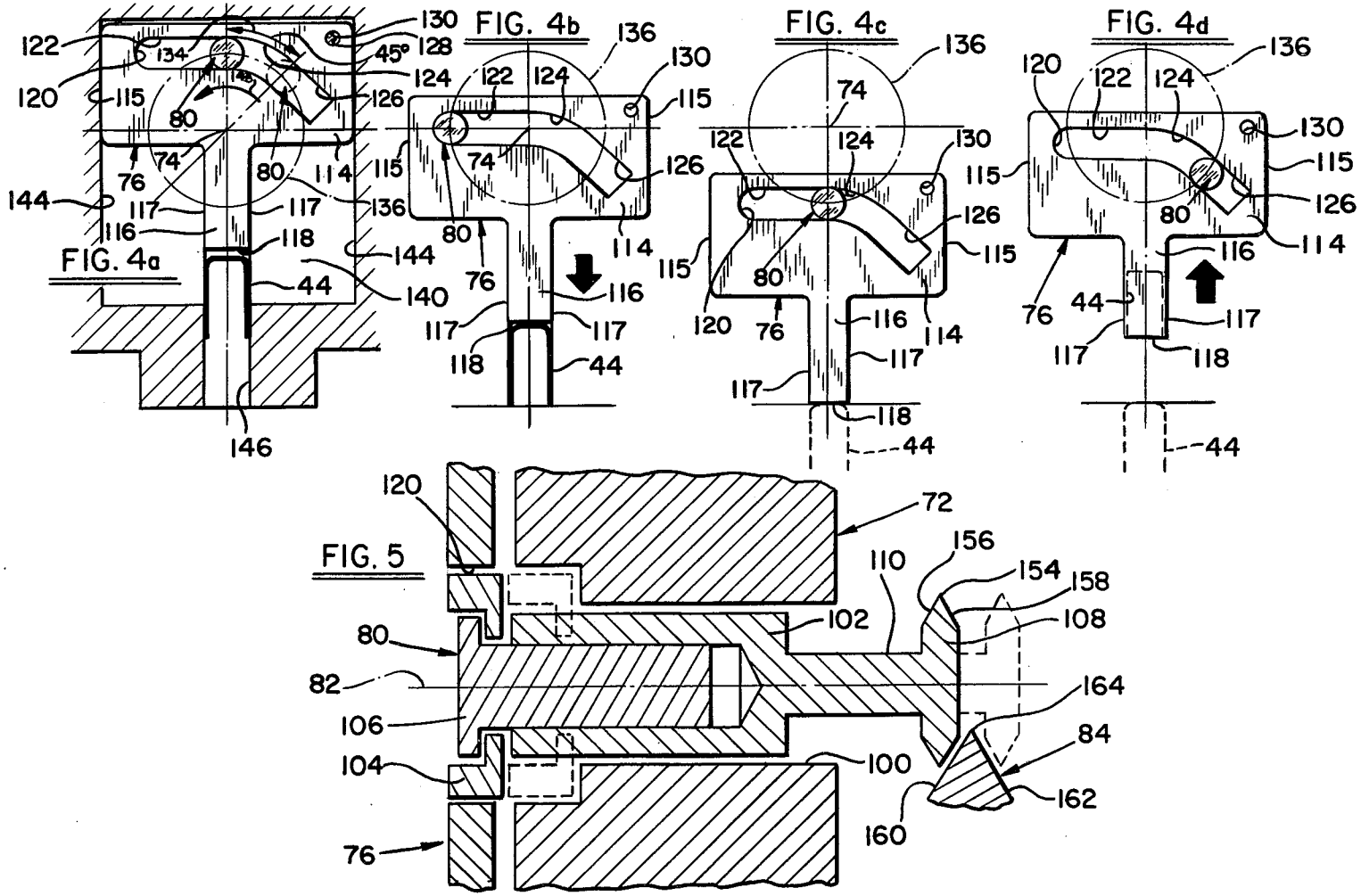
FIGS. 4*a* through 4*d* show the drive bar and the drive pin in various positions relative to the cycle of rotation of the gear, and the respective angle of the drive pin, more specifically.
FIG. 5 is an enlarged sectional elevational view of the drive pin and integral follower carried by the gear and axially shiftable therein with the solid line showing the pin inserted within the slot of the drive bar, and the follower on the front of the dual surface track; and the dotted line representation showing the follower on the rear of the track and the pin retracted from the slot of the drive bar.

The gear 72 is journaled by a bearing 92 to rotate about axis 74. The bearing 92 is affixed to a boss 94 projecting from the wall 53 of the gear case portion 36 toward the front 50 and affixed thereto by a threaded fastener 96 being screwed into a tapped hole therein. The track 84 is affixed to the boss 94 inwardly of the gear 72 and remains stationary thereon. A plurality of circumferentially spaced teeth 98 are formed on the gear to mesh with and be driven by the pinion 62. A single counterbore 100 shown in FIGS. 2 and 5 is formed on a radial line intermediate the axis 74 and the circumference of the gear 72. The drive pin 80 is disposed in the counterbore 100 to rotate with the gear 72, and is axially free to be shifted relative thereto. To this end the counterbore 100 is sized to receive a body portion 102 of the pin 80 in its smaller diameter section and to have a roller 104 nest in its front facing larger diameter section. The roller 104 of the pin 80 is trapped between the body portion 102 and an axle 106 press-fitted into a central hole in the body 102. The roller 104 is free to rotate upon the axle but cannot be axially removed from the pin 80. The follower head 108 is formed on the end of the pin 80 remote from the roller 104 and is of slightly larger diameter than the body portion 102. An intermediate section 110 of reduced diameter extends between the body 102 and the head 108. The counterbore 100 and the pin 80 have coincident axes at the axis 82, and the axes 38, 74 and 82, respectively, are parallel.

The fastener tool 20 has a rotary power source 112 formed by the assembly therein of the motor 24 and the gear 72.

The drive bar 76 shown in FIGS. 2 through 5 is a flat "T" shaped plate having a horizontally extending rectangular top 114 with straight opposed sides 115 and extending from the bottom thereof is a centrally disposed rectangular stem 116 extending vertically downwardly with opposed sides 117 which terminate in a flat striking edge 118. A slot 120 is formed in the upper portion of the top 114 to extend in a straight section 122 from the left side thereof as viewed in FIGS. 3 and 4 in a horizontal direction toward the center to curve downwardly through a curved section 124 extending in an arc of 45° and extending therefrom into an inclined section 126 which extends a short distance to terminate adjacent the lower right hand corner thereof. The drive bar 76 has a start position in which the bar 76 is stationary and held by a ball detent 128 biased to engage an aperture 130 formed in the upper right hand corner of the top 114 via a light spring 132, with the spring 132 and ball 128 disposed in a recess of the gear casing portion 36, shown in FIG. 6. The start position of the bar 76 is shown in FIG. 4*a*, wherein the gear axis 74 is coincident to the center of the arcuate section 124. Not accidentally, the arcuate section 124 corresponds to a dwell angle shown in FIG. 4*a* as an arc 134 having a 45° angle, which arc 134 is located between the dotted lined pin 80 and the solid lined pin 80 of FIG. 4*a*. The drive pin 80 will transcribe a circular path, generally designated 136, having a radius equal to the distance from the axis 74 of the gear 72 to the axis 82 of the drive pin 80.

A recess 140 is formed on the rear face 142 of the front cover 54 to extend forwardly a sufficient distance so that the complete thickness of the drive bar 76 may be disposed therein as shown in FIGS. 2. The recess 140 has straight sides 144 opposite each other and spaced sufficiently apart to guide the sides 115 of the drive bar 76 and provide lateral support therefor, while the bottom 145 of the recess 140 shown in FIGS. 6*a* and 6*b* will serve as a bearing surface and permit reciprocation of the drive bar 76 therein. The front cover 54 also has a bottom recess 146 in communication with the recess 140 and the exterior of the housing 22, and in which will be disposed a single staple 44 which is sized to have a thickness substantially equivalent to the thickness of the drive bar 76. Only a single staple 44 will enter the bottom recess 146 at a time in conjunction with the reciprocation of the stem 116 of the drive bar 76 in the recess 146. In assembled position shown in FIG. 2 the drive bar 76 will be trapped within the recess 140 of the front cover 54 by the presence of the gear case portion 36 at the rear face thereof to prevent rearward movement of the drive bar 76 during its reciprocation within the recess 140. In that limited sense the gear case portion 36 will act as a bearing surface for the rear face of the drive bar 76.

The reciprocal sequence of the drive bar 76 is shown schematically in FIGS. 4*a* through 4*d*. At the start of any driving cycle the drive bar 76 will be in the start position shown in FIG. 4*a* and the ball detent 128 will be engaged in the aperture 130 to hold the drive bar 76 stationary. With the motor 24 on the rotary power source 112 will continuously rotate the gear 72 causing the drive pin 80 to be rotated about the circular path 136. However, if the roller 104 of the drive pin 80 is in the retracted position shown in the dotted line representation of FIG. 5 the drive pin 80 will not engage the slot 120 and therefore the drive bar 76 will remain at rest and in the start position. The rotary power source 112 acts to rotate the gear 72 counterclockwise as is indicated by the arrow 148 shown in FIG. 4*a* within the circular path 136. The drive pin 80 is shiftable axially by the interrupt mechanism 78, and more particulary the shifter 86 thereof, so as to enter the slot 120 within the angled section 124 since the axially shifting of the drive pin is predetermined to occurr within the specified dwell period or arc 134, which arc 134 corresponds to the angled section 124. The slot is sized to receive the roller 104 of the pin 80 as illustrated in FIGS. 4 and 5. The 45° arc is a sufficiently long angular distance to permit full insertion or retraction of the pin into and out of the slot 120. Since the arcuate travel of the pin 80 during the dwell period matches the angled section 124 of the slot, the drive bar 76 remains stationary during such time. With the drive bar 76 in the start position shown in FIG. 4*a*, the angled section 124 remains aligned with the rotary drive pin 80 during the dwell period of arc 134. The rotary drive pin 80 can only be inserted into or retracted from the slot 120 during the 45° dwell period of arc 134 in that it is only during such period that the circular path 136 corresponds to the section 124 of the slot 120. Upon the drive pin 80 being shifted forwardly to the solid line representation shown in FIG. 5 the roller 104 is inserted into the slot 120 so as to mechanically couple the drive bar 76 to the rotary power source 112 via the gear 72 to force the drive bar 76 to reciprocate in that the transversly disposed slot 120 will permit a "Scotch Yoke" type drive to occur in which only the vertical components of motion are translated to the drive bar 76 from the circular path 136 of the drive pin 80. The solid line representation of the drive pin 80 of FIG. 4*a* corresponds to the top center position of the circular path 136 and it marks the start of the power stroke wherein the drive bar 76 will be positively driven in a reciprocal cycle in which the drive bar 76 partakes of a power stroke during the first leg thereof and a return stroke during the second leg thereof as will be shown and described in subsequent figures herein. The power stroke moves the drive bar 76 vertically downwardly and the striking edge 118 thereof impacts the staple 44 in the recess 146 and cause it to enter the workpiece. The energy transmitted from the rotary power source 112 through the drive pin 80 to the drive bar 76 is many times greater than the light holding pressure of the ball detent 128 which is easily overcome and thus the drive bar 76 is free to reciprocate responsive the positive rotation of the drive pin 80 therein.

At the end of the first quadrant which corresponds to the mid-point of the power stroke, the drive pin 80 will be at its left most position of the straight section 122 of the slot 120 as shown in FIG. 4*b*, while the striking edge 118 will start to drive the staple 44 into the workpiece. The drive bar 76 continues its downward reciprocation in the power stroke as indicated by the heavy arrow 150 pointing in the vertically downward direction.

The end of the power stroke and consequentely the first leg of the reciprocal cycle of the drive bar 76 occurs as shown in FIG. 4*c* with the staple 44 substantially completely driven into the workpiece. The drive pin 80 is at the mid-point of the slot 120 and the bottom of the circular path 136.

Continued rotation of the drive pin 80 along the circular path 136 as shown in FIG. 4*d* produces the second leg of the reciprocal cycle of the drive bar 76, namely the return stroke in which the drive bar 76 will be driven vertically upward as is indicated by the heavy arrow 152 pointing in the vertically upward direction. In this quadrant of rotation, the drive pin 80 is disposed on the right side of the slot 120 within the curved section 124 and the inclined section 126, respectively, with the latter being angled downwardly to provide a "quick return" of the drive bar 76 to restore it sooner to its start position. The accelerated return of the drive bar 76 acts to compensate for the dwell period arc 134 by returning the drive bar 76 to the start position 45° earlier in the second leg of the reciprocal cycle than occurred in the firt leg thereof, thus, establishing the 45° angle of dwell time. While one of the staples 44 is driven into the workpiece as shown in FIG. 4*d*, the next staple 44 of the magazine 48 is shown in dotted line behind the stem 116 of the drive bar 76 waiting for the drive bar 76 to return to the start position so that it can be spring biased into position within the recess 146 wherein it will await the next power stroke.

At the end of the return stroke the drive bar 76 as shown in FIG. 4*a* is at the start position, has completed both legs of its reciprocal cycle and the ball detent 128 is once again engaged in the aperture 130. Upon the drive pin 80 reaching the dwell period arc 134, the drive bar 76 being restored to the start position is and will remain stationary.

At the end of one cycle of reciprocation of the drive bar 76, the drive pin 80 is withdrawn from the slot 120 during the dwell period arc 134 shown in FIG. 4*a*. The interrupt mechanism 78 acts to prevent successive power strokes of the drive bar 76. The drive pin 80 is continuously rotated counterclockwise along the circular path 136 prior to, during and subsequent to the reciprocal cycle of the drive bar 76, and therefore, at the end of each and every reciprocal cycle thereof, and subsequent to the return stroke the drive pin 80 is withdrawn from the slot 120. The power source 112, continues to rotate the drive pin 80 in its circular path 136. The interrupt mechanism 78, includes the drive pin 80 and controls the same so that within the system parameters, dictates the occurrence of the next reciprocal cycle of the drive bar 76.

In order for the drive pin 80 to be axially shifted into the insertion or retraction positions shown in FIG. 5, namely coupled or uncoupled to the drive bar 76, a co-action must occur between it and the remaining assemblies of the interrupt mechanism 78.

The follower head 108 of the drive pin 80, best seen in FIG. 5 has an annular knife edge 154 at its point of largest circumferential diameter, and lying in a plane perpendicular to the axis 82. The knife edge 154 has inclined annular surfaces extending from the knife edge 154 toward the axis 82 and away from each other to define a front edge 156 and a rear edge 158. The angle of incline is the same for each of the edges 156 and 158 and will be equal to the angle of incline at the front 160 and the rear 162 of the track portions of the dual surface track 84. The front and rear inclines 160 and 162, respectively, are tapered upwardly and inwardly as shown in FIG. 5 to join at a knife edge 164 of the track 84.

The track 84 is also shown in FIG. 2, which depicts the knife edge 164 lying in a plane perpendicular to the gear axis 74. The track 84 is stationary and its knife edge 164 lies inside of the circular path 136 as shown in FIG. 6 which the drive pin 80 prescribes as it rotates with the gear 72 about the gear axis 74. However, the knife edge 164 has an outer circumference which is overlapped by the lower segment of the follower 108 at either of the edges 156 or 158 thereof. In fact, the inclined edges and the cooperative angle therebetween will be continuously engaged in cooperative pairs so that either the rear edge 158 will be engaged upon the front track 160, or the front edge 156 will be engaged with the rear track 162, respectively.

The drive pin 80 is restricted in its axial movement as follows: (1) toward the front; (a) by the bottom 145 of the front cover 54 when the follower 108 is at the front 160 of the track 84 or (b) if the follower 108 is at the rear 162 of the track 84, the track surface 162 itself will limit the forward motion; and (2) toward the rear; (a) by the follower 108 engaging the front 160 of the track 84 if it's at the front of the track 84, or (b) with the follower 108 at the rear 162 of the track 84 the roller 104 will bottom in the counterbore 100 to limit rearward motion of the drive pin 80.

To permit the drive pin 80 to be shifted between the front and rear tracks 160 and 162, respectively, the track 84 has a trackless or slabbed section 166 which co-acts with the shifter 86 diposed in superposition thereto. The slabbed section 166 has a leading edge 168 and a trailing edge 170 which will measure an angle therebetween from the axis 74 of approximately 45°, and which angle will substantially correspond to the dwell period arc 134 shown in FIG. 4*a*. The slabbed section 166 removes the overlap between the corresponding knife edges 154 and 164 of the pin 80 and track 84, respectively, and provides an open spaced measured on the inside of the circular path 136 in which the follower 108 may be axially shifted.

The shifter 86 is pivotally mounted within the gear case portion 36 by a cylindricle protuberance 174 so as to pivot about axis 176, but the shifter 86 affixed therein and will hold its axial position relative to the axis 176, as is illustrated in FIGS. 6 and 7. The shifter 86 has a pointed leading edge 178 as viewed in FIGS. 6 and 7 disposed on the right and a trailing edge 180 disposed on the left side thereof which includes a rectangular tab 182. An arcuate knife edge 184 extends on the lower surface of the shifter 86 from the leading edge 178 to the trailing edge 180. The curve of the edge 184 is formed with its center at the gear axis 74 and as viewed in FIG. 6 its radius will be greater than the radius of the circular path 136 but less than the radial distance to the top of the knife edge 154 of the head 108. The front 186 and the rear 188 edge inclines are tapered from the knife-edge 184 an increasing distance away from each other at an angle substantially equal to the inclined angle of the follower edges 156 and 158, respectively. The radial distances are set so that the edges 156 and 158 will overlap the rear 188 and the front 186, respectively.

The shifter 86 is normally biased by a pair of spaced springs 190 which is short, and 192 which is long, respectively, so that as best seen in FIG. 7 the leading edge 186 crosses the plane of the track 84 to lie on the front side thereof, while the trailing edge 188 is on the rear side thereof.

With the rotary power source 112 on, the gear 72 rotates the drive pin about the circular path 136 and so long as the interrupt mechanism 78 via shifter 86 is not actuated, the pin 80 will remain in the position shown in FIG. 6 which corresponds to the dotted line representation thereof in FIG. 5 in that the follower 108 has its front edge 156 engage the rear 162 of the track 84. Representative locations, "a" (solid) and "c" (dotted) and the sectional views thereof in FIGS. 6*a* and 6*c* illustrate that with the follower 108 at the rear 162 of the track 84 the drive pin is retracted from the drive bar 76. When the drive pin 80 enters the area of the trackless section 166 as at location "b" the follower 108 will engage the rear 188 of the shifter 86 as shown in FIGS. 6 and 6*b* so as to be ramped rearwardly and therefore never cross from the rear of the plane of the track 84 to the front thereof.

The lever 88 shown in FIGS. 6 and 7 remains inactive. The lever 88 has a universal mounting 194 and an arcuate flat lower edge 196 which slopes from the pointed leading edge 198 which engages the rearward side of the tab 182 to a trailing edge 200. The lever 88 is biased by a spring 202 which normally urges the trailing edge to be lifted forwardly of the plane of the tract 84 and the follower 108 as shown in FIG. 6*c* so that even though the radial distance would produce engagement between the edge 200 and the follower 108 none will normally occur so long as the lever is positioned as seen in FIGS. 6, 6*c* and 7. The lever 88 has an enlarged aperture 204 through which extends an alignment rod 206 which acts to limit the universal movement of the lever 88 and to which is connected an actuator base 208 shown in FIGS. 7, 9 and 11–13 of the arming linkage 90.

Figure 11:
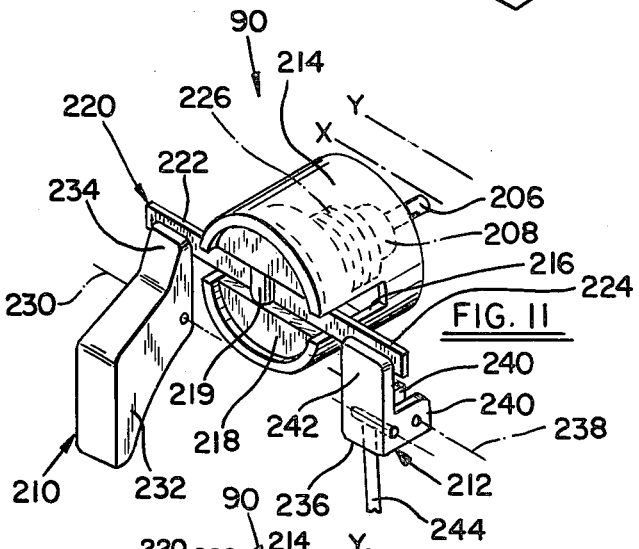
Figure 13:
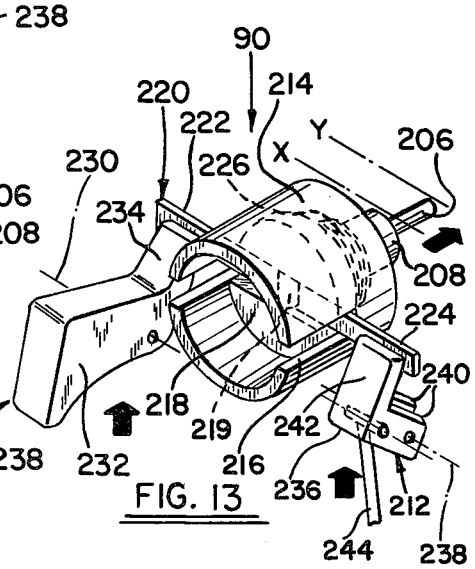
Figure 9:
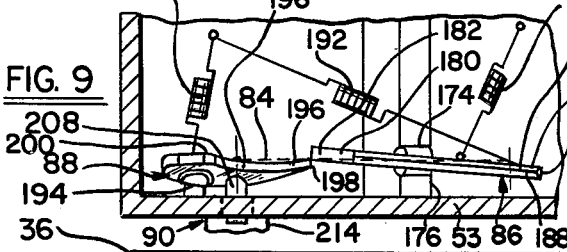
FIG. 9 is a partial sectional view taken along line 9—9 of FIG. 8, showing the lever and the shifter to ramp the drive pin to the front of the track, and wherein the track is shown in phantom.

The arming linkage 90 via the base actuator 208 as shown in FIGS. 9 and 13 is advanced toward the front 50 whenever the system parameters are met, in the preferred embodiment such parameters are actuation of both a trigger 210 and a probe 212, shown in FIGS. 1 and 11. The actuator 208 has a diameter larger than the aperture 204 of the lever 88 and will move the leading edge of the lever 88 away from the wall 53 to carry the shifter 86 via its tab 182 therewith. The actuator 208 forward movement will force the shifter 86 to pivot at 176 across the plane of the track 84 so that the leading edge 178 thereof is now adjacent the wall and on the rear side of the track 84 while the trailing edge 180 is on the front side of the track 84, as best seen in FIG. 9.

Figure 8:
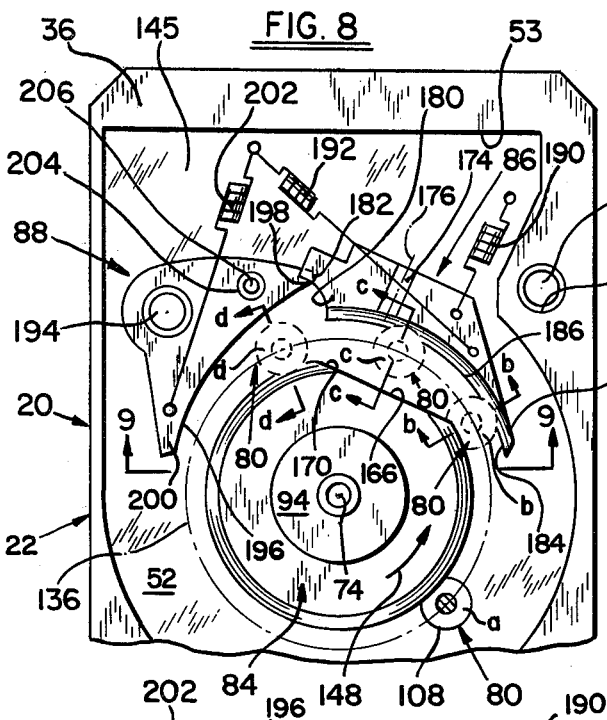
FIG. 8 is a front elevational view, similar to FIG. 6, broken away and partly in section diagramatically showing the interrupt mechanism operative to shift the drive pin follower shown at locations "a" (solid) and "b" (dotted), respectively, from the rear of the dual surface track via the shifter to the front of the track as shown at locations "c" (dotted) and "d" (dotted), respectively.
Figure 8B:
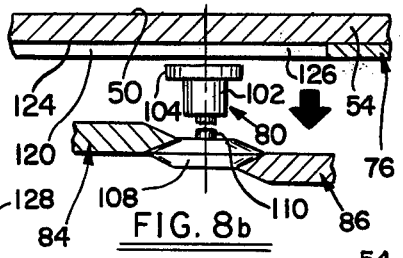
FIGS. 8*b*, 8*c* and 8*d* are each sectional views taken along lines "b—b", "c—c" and "d—d", respectively, of FIG. 8 corresponding to the noted locations "b", "c" and "d", respectively, of the drive pin of FIG. 8.
Figure 8C:
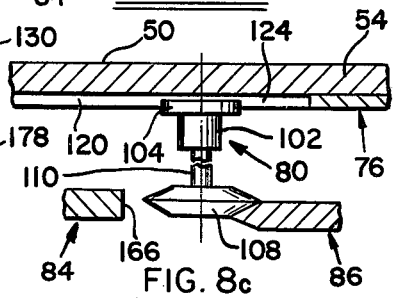
Figure 8D:
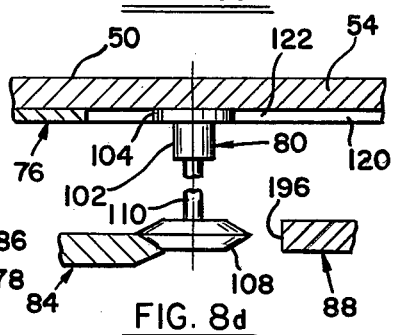

The drive pin 80 shown at location "a" of FIG. 8 is continuing in counterclockwise rotation previously described in connection with FIG. 6, but at location "b" of FIG. 8 the follower 108 is trapped between the rear 162 of the track 84 and the front 184 of the shifter 86, also shown in FIG. 8*b*, and the follower 108 will begin to ride upon the shifter 86 which had previously been mechanically shifted across the plane of the track 84 so that the shifter 86 will act to ramp the follower 108 toward the front 50 at location "c", shown in FIG. 8*c*and following the front track portion 184 of the shifter 86 will cross the plane of the track's 84 knife edge 164 to be on the front 160 of the track 84 at location "d", shown in FIG. 8*d*. The follower 108, thus, is ramped across the plane of the track 84 from the rear 162 to the front 160 thereof at the trackless section 166 thereof as shown in FIG. 8. This acts to axially shift the drive pin 80 fowardly as shown in FIGS. 8*b*, 8*c* and 8*d* from its roller 104 being spaced from the slot 120 of the drive bar 76 to being fully engaged therein. Once the drive pin 80 is engaged with the drive bar 76, continued rotation of the pin 80 produces a reciprocal cycle of the drive bar 76 and the start of the power stroke. At location "d" of FIG. 8 the drive pin's 80 follower 108 is out of contact with the flat arcuate edge 196 of the lever 88, because its radial distance from the axis 74 is to great. The slope of the edge 196 is toward the axis 74 so that the radial distance of the trailing edge 200 of the lever 88 will place it in an impact zone since the lever 88 had been pushed fowardly by the actuator 208 to place it in intersection with the plane of the track 84.

Figure 10:
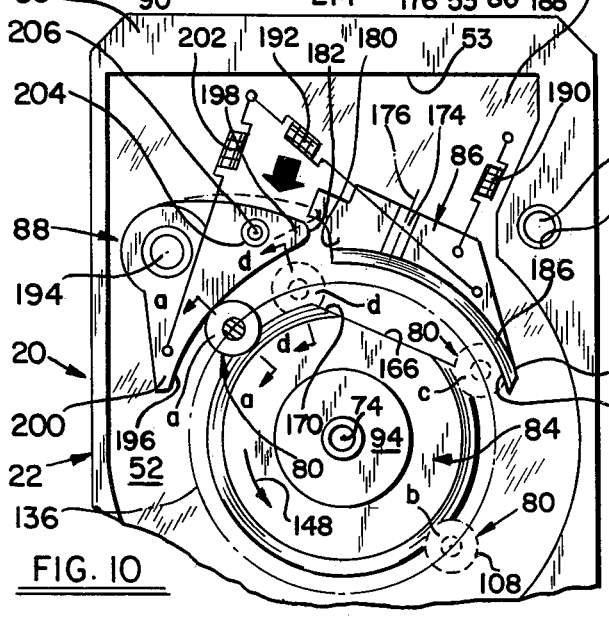
FIG. 10 is a front elevational view, similar to FIG. 6, broken away and partly in section diagramatically showing the interrupt mechanism operative to shift the drive pin follower from the front of the dual surface track as shown at locations "a" (solid) "b" (dotted) and "c" (dotted) respectively, via the shifter to the rear of the track at location "d" (dotted).
Figure 10A:
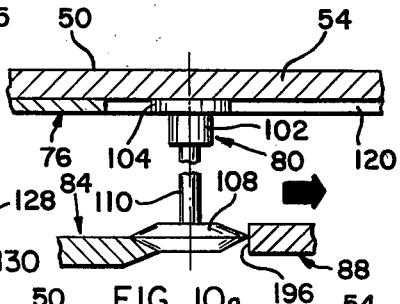
FIGS. 10*a* and 10*d* are each sectional views taken along lines "a—a" and "d—d", respectively, corresponding to the noted locations "a" and "d" of the drive pin of FIG. 10.

Immediately upon the drive pin's 80 follower 108 advancing from location "d" of FIG. 8 to location "a" of FIG. 10, the follower 108 engages the edge 196 of the lever 88 as shown in FIGS. 10 and 10*a*. Continued rotation of the follower 108 forces the lever 88 to pivot at its universal connection 194 to move the trailing edge 200 radially outwardly to produce the opposite motion at the leading edge 198 thereof from its dotted line position to its solid line position of FIG. 10 to release the tab 182 of the shifter 86, which shifter 86 will under the influence of springs 190 and 192 be pivoted to resume its FIGS. 6 and 7 position, with the leading edge 178 on the foward side of the track 84 and the trailing edge 180 on the rearward side thereof.

At location "b" of FIG. 10, the drive pin's 80 follower 108 is connected within the slot 120 of the drive bar 76, and the drive bar 76 has completed the power stroke and is beginning the return stroke, with the follower 108 still riding the front 160 of the track 84. However, when the drive pin follower 108 reaches location "c" of FIG. 10, it now encounters the leading edge 178 of the shifter 86 at the rear 188 of the shifter's 86 knife edge 184. Therefore, at location "c" of FIG. 10, the follower 108 continues to ride the front 160 of the track 84 but now rides the rear 188 of the shifter 86. The effect of this is to "ramp" or axially shift the pin 80 from the front to the rear of the plane of the track 84, and to remove its roller 104 from the slot 120 of the drive bar 76 which drive bar 76 has returned to the start position subsequent to its reciprocal cycle.

With the shifter 86 pivoted in the position shown in FIGS. 6 and 7, and the drive pin's 80 follower 108 having been ramped axially rearwardly, as it, the follower 108 rides only the rear 188 track portion of the shifter 86. Again, the ramping and axial movement of the drive pin's 80 follower 108 occurs in the region of the trackless section 166. The sequence of the ramping will only occur with the drive bar 76 in the start position and stationary.

Figure 10D:
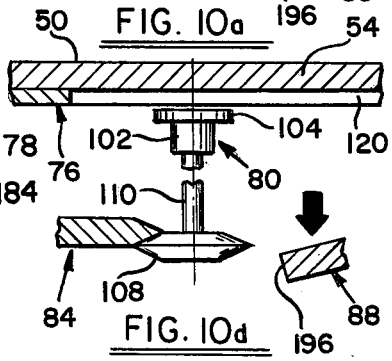

In location "d" of FIG. 10, the drive pin's 80 follower 108 has been completely ramped from the front 160 of the track 84 to the rear 162 of the track 84, as illustrated in FIG. 10*d*. The drive pin's 80 follower 108 will now repetitively revolve about its drive pin circle 136, riding the rear 162 of the track 84 and the rear 188 of the track portion of the shifter 86, repeating the sequence shown and described in FIGS. 6, 6*a*, 6*b*, and 6*c* to continuously cycle thereabout. The "system" must be re-armed before the FIG. 8 sequence of the reciprocal cycle including the power stroke can occur again. In the preferred embodiment the re-arming is controlled by the interrupt mechanism 78, via the arming linkage 90.

The system parameters are set such that even if the operator continues to depress the trigger 210 and the probe is continually engaged by the workpiece, thereby maintaining the probe 212 in continuous engagement with the lever 88 after the FIG. 8 sequence has been concluded, the shifter 86 will remain in its disarmed position, with its leading edge 178 in front of the plane of the track 84. The result is that drive pin 80 will not be shifted during its rotation and it will remain at the rear 162 of the track 84. Another fastner 44 can be fired only by disengaging one or the other of either the trigger 210 or the probe 212, or both, followed by re-engaging of that which was disengaged; or if both, than a re-engaging of both so that now both the trigger 210 and the probe 212 are simulatenously once again engaged.

In the preferred embodiment of the fastener tool 20, the system parameters for the arming linkage 90 are inputs from the trigger 210 and the probe 212 and are illustrated in FIGS. 1, 2, 3, 11, 12 and 13.

The arming linkage 90 has a junction barrel 214 mounted in the rear wall 53 of the gear case portion 36 of the housing 22 as illustrated in FIGS. 1, 7 and 9 immediately behind the aperture 204 of the lever 88. The junction barrel 214 is a hollow cylinder open at one end, with two opposing longitudinal slots 216 extending inwardly from its open end.

Figure 12:
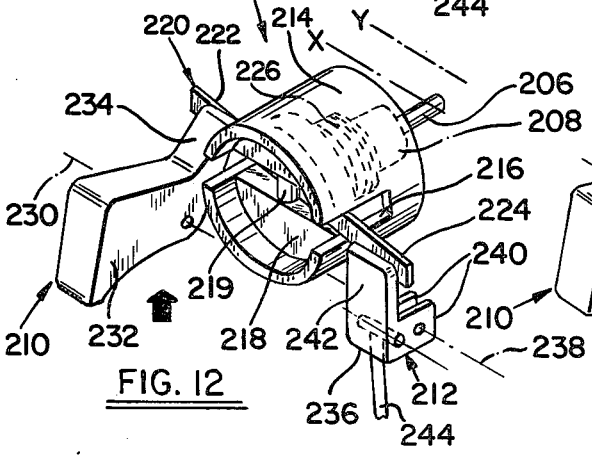

The actuator base 208 is connected to a plunger 218 slideably mounted within the barrel 214 as shown in FIGS. 11, 12 and 13. The plunger 218 is split in alignment with the slots 216 and in the split therein is pivotally affixed as at 219 a teeter 220 which extends transversely through the barrel 214 and the slots 216 to extend externally in opposite directions therefrom as viewed in FIG. 11 to form a left extension 222 that is engaged by the trigger 210, and a right extension 224 that is engaged by the probe 212. A spring 226 normally bias the plunger toward the open end of the barrel to move the actuator 208 and rod 206 to assume, the rear position shown in FIGS. 11 and 7. The actuator 208 and rod 206 extend through an opening 228 in the wall 53 of case 36 (See FIGS. 7 and 9) formed in alignment with and of larger diameter than the aperture 204 of the lever 88.

The trigger 210 is pivotally mounted at axis 230 and has a finger portion 232 extending from the handle 40 as shown in FIGS. 1 and 2, and a lever portion 234 engageable with the left extension 222 of the teeter 220. On the opposite side the probe 212 has a crank 236 pivotably connected to the housing 22 at axis 238. The crank 236 has an "L"-shaped body having a pair of parallel horizontal legs 240 at the base thereof, and transversely joined into a vertical arm 242. The legs 240 are connected to pivot about the axis 238 and the arm 242 is engageable with the right extension 224 of the teeter 220.

A probe rod 244 is pivotally connected to the legs 240 intermediate the axis 238 and the arm 242. The rod 244 extends from the crank 236 to be affixed to a pair of interconnected lower probes 246, shown in FIGS. 1 and 6, which probes have vertical slots 248 which receive horizontal pins 250 to permit limited guided vertical movement. The lower probes 246 are connected at the opposite sides of the front of the gear casing portion 36 and will project a short distance below the bottom of the housing 22. Whenever the tool 20 engages the workpiece the probes 246 are moved vertically upward, by the contact of the workpiece until the bottom of the housing 22 makes contact therewith resulting in the teeter 220 being cranked at crank 236 forwardly as shown in FIG. 13. A spring 252 is connected between the housing 22 and the rod 244 to bias the probe 212 and its components vertically downward, so that the crank 236 is normally in the position shown in FIG. 11.

The arming linkage 90 of the interrupt mechanism 78 remains unarmed as illustrated in FIGS. 11 and 12, with neither the trigger 210 nor the probe 212 having been actuated in FIG. 11, and with only one of them having been activated in FIG. 12 and the one shown as being activated being the trigger 210, though either could have been. The "X" and "Y" lines show the movement of the actuator 208 and rod 206 diagramatically, with no movement having occurred in FIG. 11, and only slight movement of the rod 206 (but not the actuator 208) having taken place at the "X" line in FIG. 12. The trigger 210 actuator 234 shown in FIG. 12 pivots the left extension 222 of the teeter 220 causing the plunger 218 to be partially depressed and to shift a short distance from the open end of the barrel 214. However, the rod does not reach the "Y" line and therefore the linkage 90 remains unarmed.

When both the trigger 210 and the probe 212 are actuated, then, in addition to the left extension 222 being shifted forwardly by the trigger 210, the right extension 224 is also shifted forwardly to move the teeter 220 an equal distance on both sides thereof to fully depress the plunger 218 within the barrel 214 and move the actuator 208 and the rod 206 to its full forward position, adjacent the "X" and "Y" lines, respectively, as illustrated in FIGS. 9 and 13. Thus the arming linkage 90 becomes operative by placing the lever 88 in its forward position of FIG. 9 resulting in a ramping of the shifter 86 to produce the reciprocal cycle of the drive bar 76 which as shown in FIG. 10 is followed by a subsequent automatic cycling of the drive pin 80 to effect release of the shifter 86 to release the pin 80 from the drive bar 76 and restore the drive pin 80 to rotary cycling only.

The interrupt mechanism 78 includes the arming linkage 90 which co-acts with the lever 88 and the shifter 86 to initiate and terminate each reciprocal cycle of the drive bar 76 responsive to the drive pin 80 being axially shifted into and out of engagement with the drive bar 76 so as to produce a maximum of one-half the number of reciprocal cycles and power strokes thereof for the total number of cycles of the drive pin 80. Also, successive power strokes are not possible since after every reciprocal cycle of the drive bar 76 upon its return to the start position there is complete disengagement with the drive pin 80 for at least one complete rotary cycle thereof before it is possible to again initiate a reciprocal cycle, but then only if the arming linkage 90 has been activated.

It will be understood that various changes in the details, materials, arrangements of parts and operating conditions which have been herein described and illustrated in order to explain the nature of the invention may be made by those skilled in the art within the principles and scope of the invention.

I claim:

1. A fastener tool system, comprising:
(a) a source of rotational energy connected to the tool, and said source rotatable through a first cycle;
(b) a fastener to be driven by the tool;
(c) a drive member moveable in the tool through a second cycle defined by a power stroke to drive the fastener and a return stroke,
(d) means in the tool for linking the source of rotational energy to the drive member to drive the drive member through the power stroke and the return stroke, said means further including means for terminating successive second cycles while the source of rotational energy is continuously rotated.

2. The combination claimed in claim 48, wherein:
(a) the means for linking the source of rotational energy to the drive member includes a rotating transmission member;
(b) the drive member reciprocates along an axis; and
(c) the reciprocation of the drive member is in predetermined relation to the rotation of the transmission member.

3. The combination claimed in claim 2, wherein:
(a) the means for linking further includes a link member; and
(b) the link member being drivingly connected between the transmission member and the drive member during each second cycle.

4. The combination claimed in claim 3, wherein the link member rotates in unison with the transmission member during each second cycle.

5. The combination claimed in claim 4, wherein the link member is carried by the transmission member.

6. The combination claimed in claim 3, wherein the means for terminating successive second cycles includes means operatively associated with the angular position of the link member, for disconnecting the link member from driving relation between the transmission member and the drive member.

7. A fastener tool carrying a plurality of fasteners to be individually driven into a workpiece, comprising:
(a) a power source mounted in the tool,
(b) a drive bar having a transverse slot and reciprocally mounted in the tool successively to impact with at least one of the fasteners,
(c) a driven means connected to be driven by the power source, and selectively connectable to the drive bar,
(d) the driven means includes a gear continually rotated by the power source during operation of the tool,
(e) interrupt means operatively associated to cycle the driven means between a coupled position for reciprocating the drive bar and an uncoupled position which disengages the driven means from the drive bar after each coupled position,
(f) the interrupt means including a drive pin connected to rotate with and be shiftable relative to the gear, and a shifter means to selectively shift the drive pin for coupling the gears and the drive bar, and uncoupling the same, and
(g) the shifter means further including a clutch means operative in a predetermined cyclic manner to cause the drive pin to be engaged and disengaged with the slot of the drive bar.

8. The combination claimed in claim 7 wherein:
(a) the clutch means includes a track and a shift member, and
(b) the drive pin includes a follower, which follower is engaged and guided by said track, and which follower is selectively shifted by the shift member between an engaged position and a disengaged position with the drive bar.

9. The combination claimed in claim 8 wherein:
(a) the track has two surfaces, an engage surface and a disengage surface, and
(b) the shift member selectively positions the follower on one or the other of the track surfaces.

10. The combination claimed in claim 9 wherein:
(a) a control means engages the shift member to cause the shift member to move the follower from the disengage surface to the engage surface.

11. A fastener tool carrying a plurality of fasteners to be individually driven into a workpiece, comprising:
(a) a power source mounted in the tool;
(b) a drive bar reciprocally connected to the tool to impact successively with at least one of the fasteners;
(c) linking means for selectively coupling the drive bar to the power source to drive the drive bar through a power stroke and a return stroke; and
(d) said linking means including a linking member continuously drivingly engaging the drive bar during the power stroke and the return stroke.

12. The combination claimed in claim 11, wherein:
(a) the drive bar includes a drive surface internally formed in the drive bar; and
(b) the link member is engaged with the drive bar internal drive surface during the power and return strokes.

13. The combination claimed in claim 11, wherein the linking means further includes a continuously rotating gear powered by the drive source and drivingly connected to the drive bar during both the power and return strokes.

14. The combination claimed in claim 13, wherein the gear is drivingly connected to the link member during both the power and return strokes.

15. The combination claimed in claim 11, wherein:
(a) said drive bar has a front face and a rear face; and
(b) the link member extends transversely outwardly of the rear face during the power and return strokes.

16. The combination claimed in claim 15, wherein:
(a) the tool defines a bearing surface; and
(b) the front face is engageable with the bearing surface.

17. The combination claimed in claim 11, wherein:
(a) the power source includes a continuously rotating motor;
(b) the drive member is a drive pin shiftable to couple or uncouple the motor and the drive bar; and
(c) said means further includes interrupt means operatively associated with the pin and actuatable to shift the pin between a coupled position and an uncoupled position, and operative to shift the pin to the uncoupled position after each coupled position thereof.

18. The combination claimed in claim 17, wherein the interrupt means includes an actuator means to permit and to prevent the pin to shift relative the drive bar.

19. A fastener tool for discharging individual fasteners from a magazine carried by the tool, comprising:

(a) a rotary power source mounted in the tool and continuously rotating during operation of the tool;

(b) a drive bar mounted in the tool to transcribe a path therein to impact a fastener during a drive stroke; and to return to a start position during a return stroke;

(c) a driven member rotatably connected to the power source and moveable through a predetermined arc of rotation; and (d) coupling means for drivingly connecting the driven member to the drive bar during the predetermined arc of rotation, such that the drive bar is driven through the drive stroke and the return stroke during said arc.

20. The combination claimed in claim 19, further comprising uncoupling means operatively associated with the coupling means for disconnecting the driven member from a driving relation to the drive bar at the end of said predetermined arc.

21. The combination claimed in claim 19, wherein:

(a) the drive bar defines a cam surface; and (b) the coupling means includes a cam follower in engagement with the cam surface during the predetermined arc of rotation of the driven member.

22. The combination claimed in claim 21, wherein:

(a) the drive bar is a yoke; and (b) the cam follower includes a pin operatively associated with the driven member.

23. The combination claimed in claim 22, wherein:

(a) the slot has a curved portion; and (b) the uncoupling means is operative to disconnect the drive member when the pin is located at the slot curved portion.

* * * * *

UNITED STATES PATENT AND TRADEMARK OFFICE

CERTIFICATE OF CORRECTION

PATENT NO. : 4,449,660

DATED : May 22, 1984

INVENTOR(S) : Somers H. Smith, III

It is certified that error appears in the above-identified patent and that said Letters Patent is hereby corrected as shown below:

Column 13, line 21, the claim reference numeral "48" should read --1--.

Signed and Sealed this

*Twenty-third* Day of *October 1984*

[SEAL]

*Attest:*

GERALD J. MOSSINGHOFF

*Attesting Officer*

*Commissioner of Patents and Trademarks*